US005158448A

United States Patent [19]

Kawasaki et al.

[11] Patent Number: 5,158,448

[45] Date of Patent: Oct. 27, 1992

[54] CATALYTIC BURNING APPARATUS

[75] Inventors: Yoshitaka Kawasaki, Nabari; Atsushi Nishino, Neyagawa; Jiro Suzuki, Nara; Masato Hosaka, Osaka, all of Japan

[73] Assignee: Matsushita Electric Industrial Co., Ltd., Osaka, Japan

[21] Appl. No.: 474,762

[22] PCT Filed: Aug. 2, 1989

[86] PCT No.: PCT/JP89/00795

§ 371 Date: Mar. 23, 1990

§ 102(e) Date: Mar. 23, 1990

[87] PCT Pub. No.: WO90/01656

PCT Pub. Date: Feb. 22, 1990

[30] Foreign Application Priority Data

Aug. 4, 1988 [JP] Japan ..... 63-194966

[51] Int. Cl.[5] ..... F23H 5/00

[52] U.S. Cl. ..... 431/74; 431/78; 431/328

[58] Field of Search ..... 431/74, 78, 328, 329

[56] References Cited

U.S. PATENT DOCUMENTS 4,773,847 9/1988 Shukla et al. ..... 431/328

4,927,353 5/1990 Nomura et al. ..... 431/328

FOREIGN PATENT DOCUMENTS 60-233415 11/1985 Japan .

62-62821 7/1987 Japan .

*Primary Examiner*—Carroll B. Dority

*Attorney, Agent, or Firm*—Stevens, Davis, Miller & Mosher

[57] ABSTRACT

There are arranged a mixing room (4) for mixing fuel with air, flame ports (5) disposed downstream of the mixing room, an ignition plug and a flame rod disposed near the flame ports, and a catalyst layer (8) disposed downstream of the flame ports and bored with a plurality of communicating holes (8*a*). The operation includes steps of activating the igniting means (6) for forming a flame at the flame ports (5), extinguishing the flame after a predetermined time length by once stopping the fuel supply, and starting a catalytic burning reaction on the surface of the catalyst layer (8) by supplying fuel again without activating the igniting means (6). The operation is controlled in such a manner that, in the flame forming step at the flame ports (5), the burning is stopped when the ion current detecting means (7) does not detect a predetermined electric current, and, in the catalytic burning step at the catalyst layer (8), the burning is stopped, in contrast with the above, when the ion current detecting means detects the predetermined electric current.

7 Claims, 8 Drawing Sheets

CATALYTIC BURNING APPARATUS

TECHNICAL FIELD

The present invention relates to a catalytic burning apparatus for effecting an oxidizing reaction of fuel on a solid oxidizing catalyst.

BACKGROUND ART

Heretofore, several apparatus for effecting an oxidizing reaction of liquid or gaseous fuel on a solid oxidizing catalyst have been proposed, for example, an apparatus as shown in FIG. 1 (Catalyst, Vol. 29, No. 4, 313, 1987).

In FIG. 1, numeral 101 denotes a fuel pipe, numeral 102 ejection ports, numeral 103 an insulator layer, numeral 104 an electric heater, numeral 105 a catalyst layer, and numeral 106 a cover. Fuel is supplied through the ejecting ports 102 formed in the fuel tube 101 in a distributed manner, and passed through the porous insulator layer 103 to the catalyst layer 105 which is preheated by the electric heater 104. On the other hand, air is supplied from the underside of the cover 106 under the function of convection. Near the surface of the catalyst layer 105, the fuel and the air are mixed with each other by diffusion, and a catalytic burning is effected on the fibered porous catalyst layer 105.

The catalytic burning apparatus of this type, however, has problems as follows. Firstly, it is required to heat the catalyst layer 105 to a temperature at which the catalytic reaction starts, and it takes a long time to heat the catalyst layer to the predetermined temperature by the electric heater 104, unless a heater of a great capacity is used. Secondly, since the catalyst layer 105, from the surface of which the heat is radiated forwards, is only covered in a halfly exposed manner by the cover 106 made of such as a porous metal, there is a fear that the burning is interrupted by a gust or a water spray, frequently causing an imperfect combustion and producing an offensive smell and a harmfull carbon monoxide. Thirdly, when the apparatus is used for a long time and the activity of the catalyst layer is deteriorated, there occurs a fear that the imperfectly burned fuel flows out, and an offensive smell and a great amount of harmful carbon monoxide are continuously produced due to the imperfect combustion, because there is provided no detecting means for detecting the deterioration of the catalyst layer. Fourthly, in the case where the fuel is burned in a closed space such as in a room, the burning is not stopped as far as the temperature of the catalyst layer is maintained in a predetermined range, even when the oxygen density has been decreased to a level having an adverse influence on the human health, thereby causing a continuation of the oxygen starvation and the imperfect combustion.

DISCLOSURE OF INVENTION

The present invention provides a catalytic burning apparatus which can solve the above-mentioned problems and is superior in burning control capability and in safety. The present invention has a characterizing feature that flame ports added with ignition means and ion current detecting means are disposed upstream of the catalyst layer, and an abnormal combustion environment or combustion condition is detected based on the ion current value.

BEST MODE FOR CARRYING OUT THE INVENTION

Figure 7:
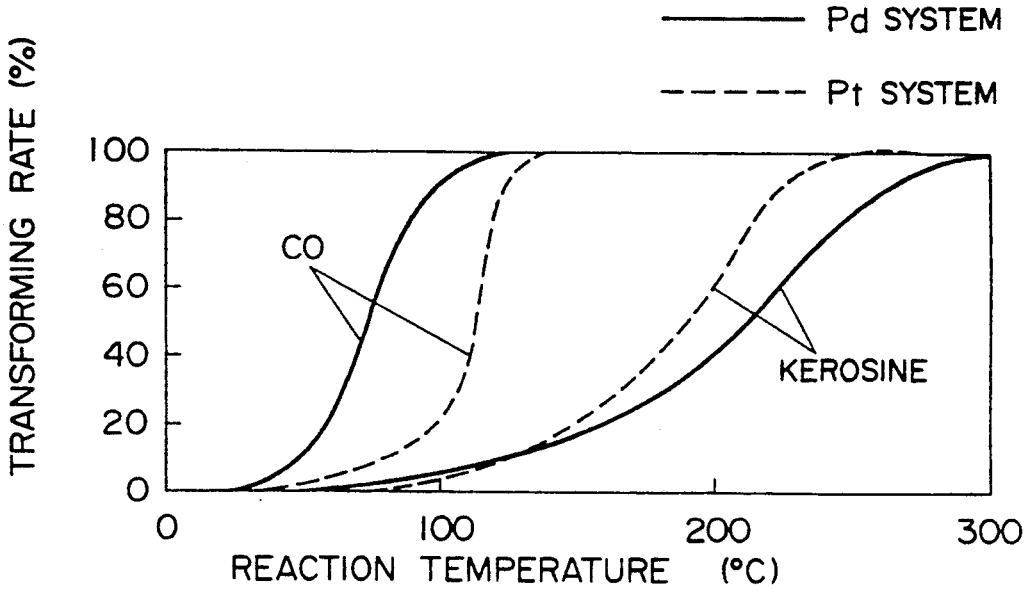
FIG. 7 is a performance illustration for showing variation of transforming rates in oxidizing reaction on kerosene or carbon monoxide due to the composition of precious metals.
Figure 8:
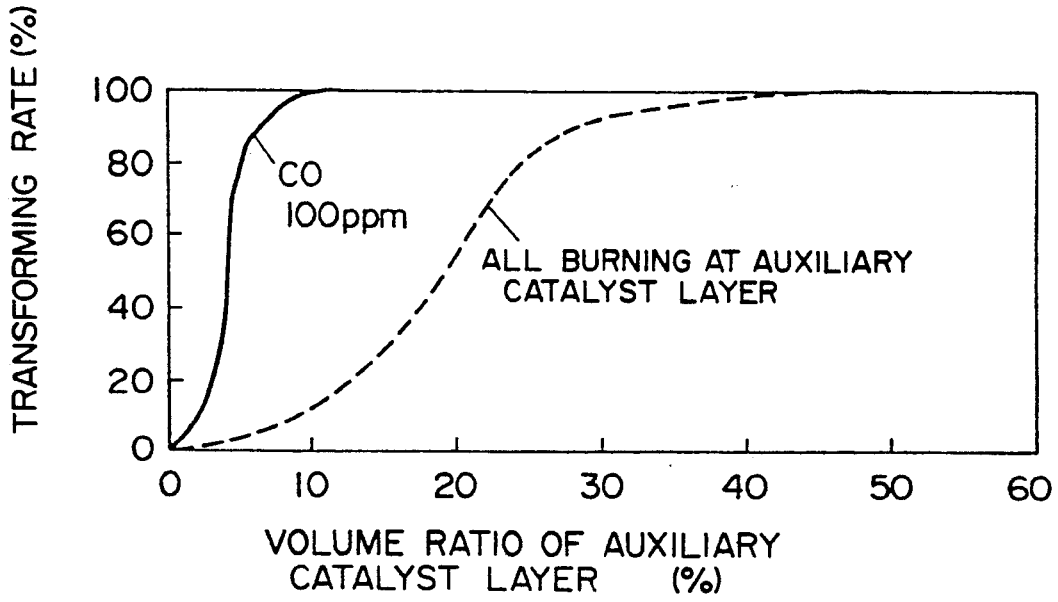
FIG. 8 is a performance illustration for showing an influence of the ratio of the auxiliary catalyst volume to the catalyst layer volume on the transforming rates in oxidizing reaction on kerosene or carbon monoxide.
Figure 9:
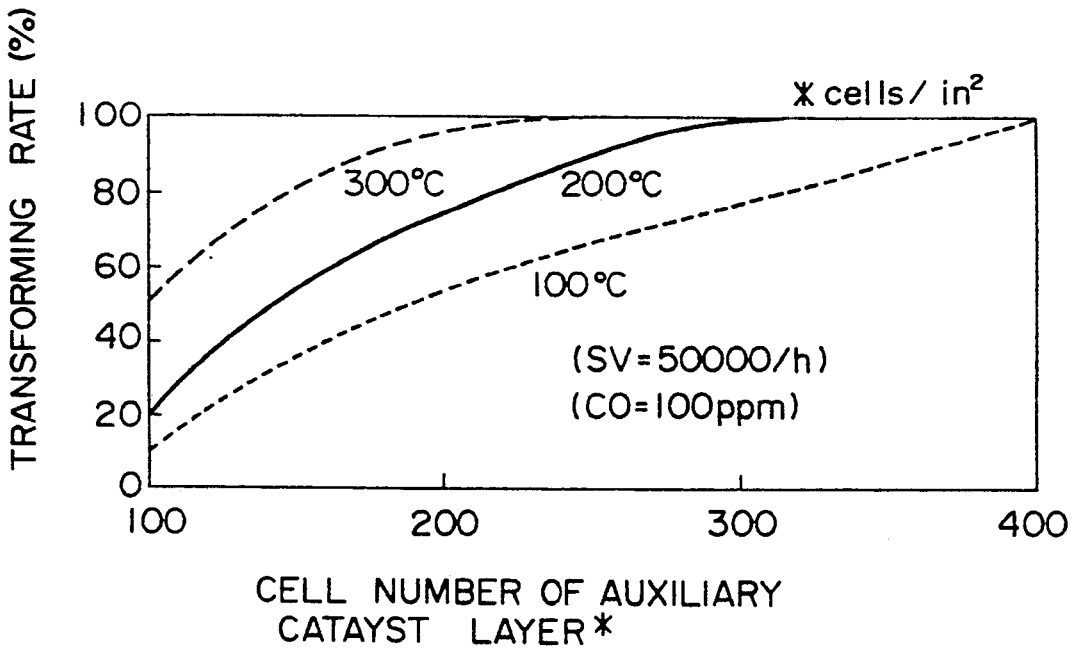
FIG. 9 is a performance illustration for showing an influence of the cell number of auxiliary catalyst layer on the transforming rate in oxidizing reaction on the carbon monoxide.

Embodiments of the present invention will be described below. FIGS. 2 to 6 relate to embodiment of the present invention, and in these figures, the same constituent members are indicated with the same numerals. FIGS. 7 to 9 relate to catalytic performances showing influences of the structure of catalyst layer or auxiliary catalyst layer and composition of the precious metals on the oxidizing reaction on kerosene or carbon monoxide.

Figure 1:
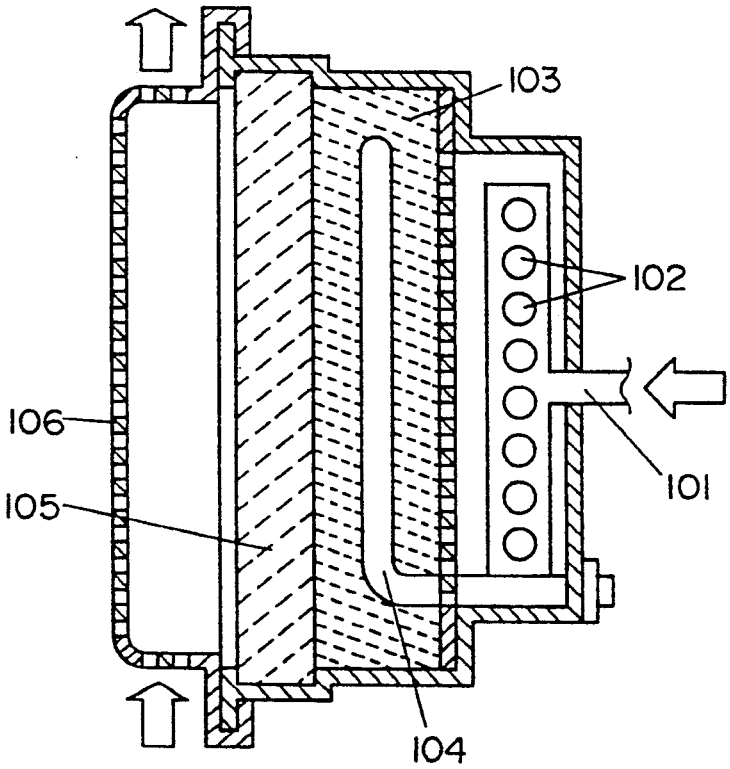
FIG. 1 is a structural view of a catalytic burning apparatus of a prior art.
Figure 2:
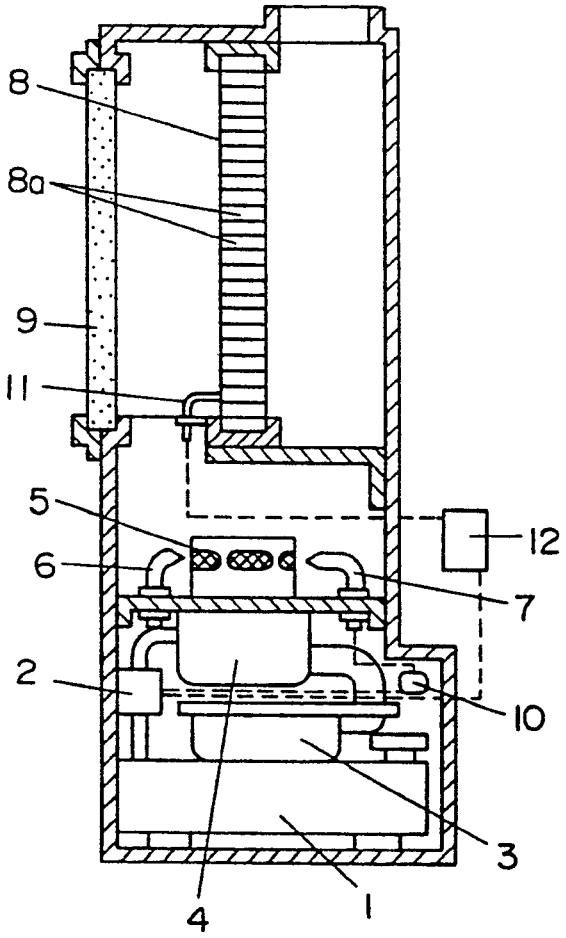
FIG. 2 is a structural view of a catalytic burning apparatus according to a first embodiment of the present invention.

In FIG. 2, numeral 1 denotes a liquid fuel tank, numeral 2 a fuel pump, numeral 3 an air blast fan, numeral 4 a mixing room. At the exit of the mixing room 4 are provided flame ports 5, and near the flame ports 5 are provided an ignition plug 6 and an electrode for measuring the ion current in the flame, i.e. so-called a flame rod 7.

Above the flame ports 5 is provided a vertically arranged catalyst layer 8 which includes an active composition of platinum metal carried out a honeycomb-like ceramic flat plate mainly composed of silica-alumina and bored with a plurality of communicating holes 8*a*. Upstream of the catalyst layer 8 (front side) is arranged a transparent window 9 made of a glass plate and located opposite to the catalyst layer 8. Numeral 10 denotes a control section for the pump 2, numeral 11 a thermocouple for detecting the temperature of the catalyst layer 8, and numeral 12 a burning control circuit.

Next, the operation will be described in detail. The fuel (kerosene) supplied from the fuel pump 2 is vaporized in the mixing room 4, sufficiently premixed with the air supplied from the fan 3, and transferred to the flame ports 5 locating above. Firstly, the mixed gas is ignited at the flame ports 5 by the ignition plug 6, thereby starting a flame burning. The exhaust gas of high temperature flows upwards and passes through the communicating holes 8*a* and flows to downstream side, while the temperature of the catalyst layer is raised. When, after burning for a predetermined time length, the thermocouple 11 detects that the temperature of the catalyst layer 8 reaches a sufficiently high temperature, the pump 2 is once stopped for putting out the flame, and is started again. In this process, the premixed gas coming from the mixing room 4 flows to the catalyst layer 8 which is vertically arranged above. Since the catalyst layer 8 has been sufficiently heated, the mixed gas effects catalytic burning mainly at the upstream side (front surface) surface, and the burned exhaust gas flows to the downstream side (rear surface) through the communicating holes 8a. A part of the reaction heat generated at the surface of the catalyst layer 8 penetrates through the transparent window 9, and another part of the reaction heat heats the transparent window 9 and is radiated from the window as a secondary radiation, these heats being radiated to the front side and used for room heating or the like. At the ignition time when the flame is formed at the flame ports 5, the flame rod 7 confirms that an ion current of a predetermined flow rate is flowing in the flame, and whereby a misignition or a misfire is detected.

On the other hand, at the time when the flame at the flame ports 5 has been extinguished and the catalytic burning on the catalyst layer 8 has been started, the flame rod 7 confirms, in contrast with the above, that no flame exists at the flame ports 5, in other words, no ion current is flowing, thereby detecting that the burning has been completely switched into the catalytic burning, and any flame due to an incomplete extinguishment or a back-fire from the catalyst layer 8 to the flame ports 5 does not exist at the flame ports 5.

By utilizing the flame heat produced at the flame ports 5 for preheating the catalyst layer 8, the whole amount of the high temperature exhaust gas is passed through the communicating holes 8a of the catalyst layer 8, thereby uniformly heating the whole region of the catalyst layer 8. As a result, an efficient preheating can be achieved. For example, the time required for pre-heating the catalyst layer 8 to a predetermined temperature is about 3 to 5 minutes in case of using an electric heater of 1.5 kW, while it is not more than one minute in case of using a flame burning of 1200 kcal/h. Further, in case of an electric heater, the temperature is easily raised near the heater, but very slowly raised at the region remote from the heater, while in case of a flame burning, the temperature is uniformly raised in a short time without any local unevenness of the temperature. In addition, there is not any fear that an electric heater suffers an oxidizing corrosion or a heat damage near the catalyst layer 8 which is constantly under high temperature and oxidizing condition. Further, since an abnormality in a burning start or in a catalytic burning is always detected by the flame rod 7, a favorable result can be obtained with respect to life length or stability and safety of burning.

Although, in the above-mentioned arrangement, the combustion air is totally supplied to the mixing room 4, it is also possible to supply a part of the air to near the flame ports 5 for effecting a diffusion flame burning of the partially premixed gas. In this case, the variation of the ion current is significant, thereby improving the detecting precision of the flame rod 7 and assuring a surer detection of the flame burning without deteriorating the perfect combustion feature of the catalyst layer 8. The time length of the flame burning required for preheating the catalyst layer 8 can be controlled by presetting it to a predetermined value which is large enough for sufficiently raising the temperature of the whole catalyst layer 8. However, it is surer to detect the temperature of the catalyst layer 8 by means of a thermocouple 11 and confirm the temperature state. In the latter arrangement, in case of a re-igniting just after extinguishes a fire, where the temperature of the catalyst layer is comparatively high, there is obtained an advantage that an excessive preheating can be omitted and a quick switching into a catalytic burning can be carried out.

Further, the thermocouple 11 provided at the catalyst layer 8 for detecting the preheating temperature as mentioned above can also achieve a temperature control function for catalytic burning. For example, it is possible to detect an abnormal burning based on a drop of the temperature of the catalyst layer 8, when the activity of the catalyst layer 8 has been deteriorated, or the catalyst layer has been partly damaged and the reaction has become imperfect. In detail, in case the catalytic activity is deteriorated, the central position of the catalytic burning shifts from the upstream side (front side) of the catalyst layer 8 to the downstream side (rear side), and there occurs a temperature distribution change that the temperature at the upstream side is lowered, and the temperature at the downstream side is raised, or the temperature of the downstream exhaust gas is raised. By comparing these temperature distribution change with a relation between fuel supply rate and temperature distribution which is precalculated and stored in the control circuit 12, an abnormal burning can be surely detected, and the burning can be stopped based on the detected abnormality. In case of a partial damage of the catalyst layer 8, the fuel flows as gathering to the damaged portion, and the temperature of the catalyst layer 8 is lowered, thereby making it possible to detect the abnormality. On the other hand, in case the surface temperature of the catalyst layer 8 become significantly high due to an abnormality of the pump 2 or the fan 3, the temperature change is detected by the thermocouple 11, and a suitable control action such as indicating an abnormality sign or stopping the burning can be carried out, thereby assuring a safe and stable burning.

Although, in the above arrangement, a thermocouple is used as temperature detecting means, any other temperature detecting means can be selected, for example, a thermometer of a resistance type such as a thermistor or a thermometer of a radiation type using light. As to the location of the thermometer, it is not always necessary to locate the thermometer near the catalyst layer 8, but it is also possible to locate the thermometer in the exhaust gas passage as mentioned above for measuring the temperature of the exhaust gas, or to locate the same outside of the transparent window 9 for measuring the radiated heat amount. Since the catalyst layer 8 is located in a closed passage extending downstream of the flame ports 5, various external disturbing factors, for example, a gust blowing in or a water spray, have no direct influence on the catalyst layer 8 so that no imperfect burning or no local misburning is caused, and a stable and perfect burning can be maintained.

In case of kerosene catalytic burning having an air ratio of about 1.5, the total amount of the oxygen is sufficient, even if the oxygen density becomes as low as 15%, in other words, the oxygen excessive ratio, i.e. the ratio of an actual oxygen amount to a theoretically required oxygen amount is maintained as high as about 1.1. In consequence, the burning reaction is maintained at the catalyst layer 8. However, the oxygen density in a room below 16% stands in an unsafe range having a harmful influence on the human body. Here, during catalytic burning, if a flame is formed at the flame ports 5 by applying an electric current to the ignition plug 6, and at the same time, the flame rod 7 is switched to the flame detecting mode as seen in the preheating process, an oxygen starvation state can be detected by measuring the change of the ion current flowing through the flame by means of the flame rod 7, because the state of the flame and the ion density in the flame vary according to the oxygen density. In case the ion current value is beyond a predetermined value, an oxygen starvation is concluded and the pump 2 is stopped through the controller section 10 for interrupting the burning. Some flame ports have a feature that, when the oxygen is starved, the formation of a stable flame becomes difficult and the flame blows out. In this case, the oxygen starvation can be detected in a surer manner. By suitably setting the electric current value, the burning can be stopped when the oxygen density reaches 18% or 16%, thereby preventing any unsafe operation. In this case, when the ion current value is not beyond the predetermined value, the fuel supply is temporarily interrupted similarly to the ignition phase for extinguishing the flame at the flame ports 5, and then the fuel supply is again started for continuing the catalytic burning at the catalyst layer 8. By conducting the above-mentioned operation for a short time such as one to two minutes at intervals of such as 30 minutes or one hour, the oxygen starvation can be detected. Further, since this operation is controlled by the ignition plug 6 which is normally used in the preheating process for the catalyst layer 8 and by the flame rod 7 which is normally used for detecting a misignition or a misfire, a sure safety can be assured in a simple manner.

Figure 3:
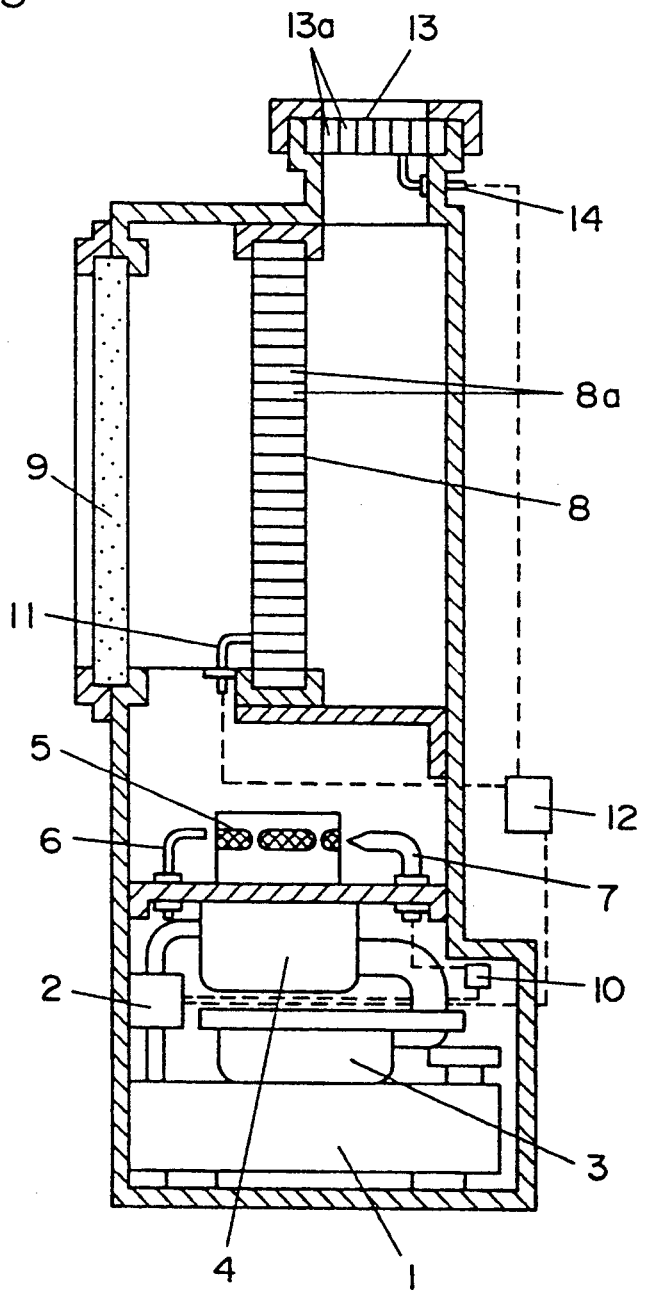
FIGS. 3, 4, 5 and 6 are structural views of catalytic burning apparatus according to second, third, fourth and fifth embodiments of the present invention, respectively.

Next, a second embodiment will be described. Referring to FIGS. 3, downstream of the catalyst layer 8 is arranged an additional auxiliary catalyst layer 13, which is also added with a thermocouple 14. The auxiliary catalyst layer 13 is a honeycomb-like ceramic plate carrying an active composition of precious metals and bored with a plurality of communicating holes 13*a*. Similarly to the above-mentioned embodiment, a burning is started through steps of forming a flame at the flame ports 5, preheating the catalyst layer 8 and the auxiliary catalyst layer 13 by using the combustion exhaust gas, extinguishing the flame by once stopping the pump 2, and starting a catalytic burning at the catalyst layer 8 by activating the pump 2 again. The combustion exhaust gas further flows upwards to the downstream side, and contacts with the auxiliary catalyst layer 13, where the unburned fuel, if any, is completely oxidized and thereafter exhausted upwards through the communicating holes 13*a* as a clean exhaust gas. In consequence, even when the fuel is not completely burned at the catalyst layer 8 due to an uneven preheating or an uneven temperature distribution, the mixing is again effected and the mixed gas contacts with the auxiliary catalyst layer 13 located downstream, thereby completing the reaction and preventing any unburned gas due to an imperfect combustion from being exhausted. Further, even in case the activity of the catalyst layer 8 has been deteriorated due to a long use, the activity is compensated by the catalyst layer 13, and a stable performance can be maintained for a long time.

Figure 4:
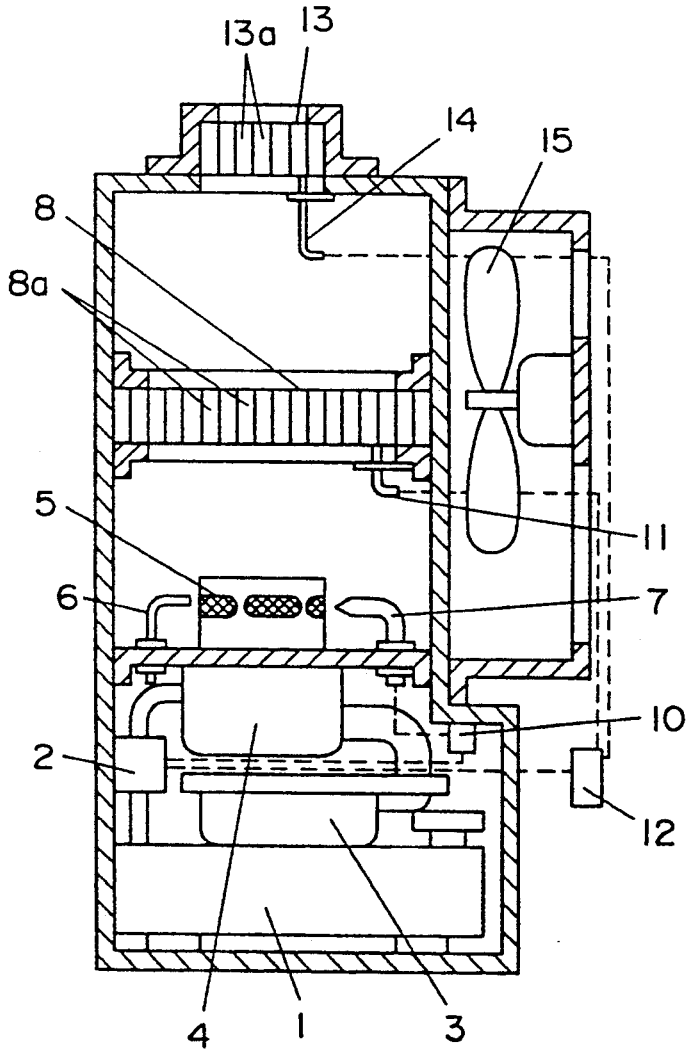

In case the activity of the catalyst layer 8 drops down, the reaction position gradually shifts from near the upstream side surface to the downstream side, and finally, the fuel cannot be burned perfectly, permitting a part of the fuel to pass therethrough in an unburned condition or permitting carbon monoxide, which is considered as an intermediate dissolved composition or a reaction intermediate composition, to be mixed into the exhaust gas. Accordingly, the temperature of the catalyst layer 8 detected by the thermocouple 11 becomes low. On the other hand, at the auxiliary catalyst layer 13 located at the downstream side, a combustion reaction of the unburned fuel is effected, and due to this reaction heat, the temperature of the auxiliary catalyst layer 13 detected by a thermocouple 14 becomes high. Thus, the temperature of the catalyst layer 8, which is much higher than that of the auxiliary catalyst layer 13 at an initial stage, is gradually lowered relative to the temperature of the auxiliary catalyst layer 13, and finally the temperature relation between the two catalyst layers is reversed. Even in this temperature reversed condition, since a sufficient activity is maintained at the catalyst layer 13, there is contained no unburned fuel or carbon monoxide in the final exhaust gas, thereby maintaining the exhaust gas at a clean state. Further, in case the temperature difference between the temperatures detected by the thermocouple 11 and the thermocouple 14 become smaller than a predetermined value, this difference is judged to indicate a life limit of the catalyst layer 8, and can be used as a signal for stopping the burning. Thus, the deterioration of the catalyst layer can be surely detected, and any imperfect combustion can be prevented. The catalyst layer 8 may be arranged vertically as shown in FIG. 3 and may be provided with a transparent window at the upstream side for utilizing the radiant heat, or may be, as seen in a third embodiment shown in FIG. 4, provided with a air blowing fan 15 for transforming the combustion heat into a warm wind for room heating. Thus, there is no limitation with respect to the arrangement of the catalyst layer 8 or to the utilizing form of the reaction heat.

Figure 5:
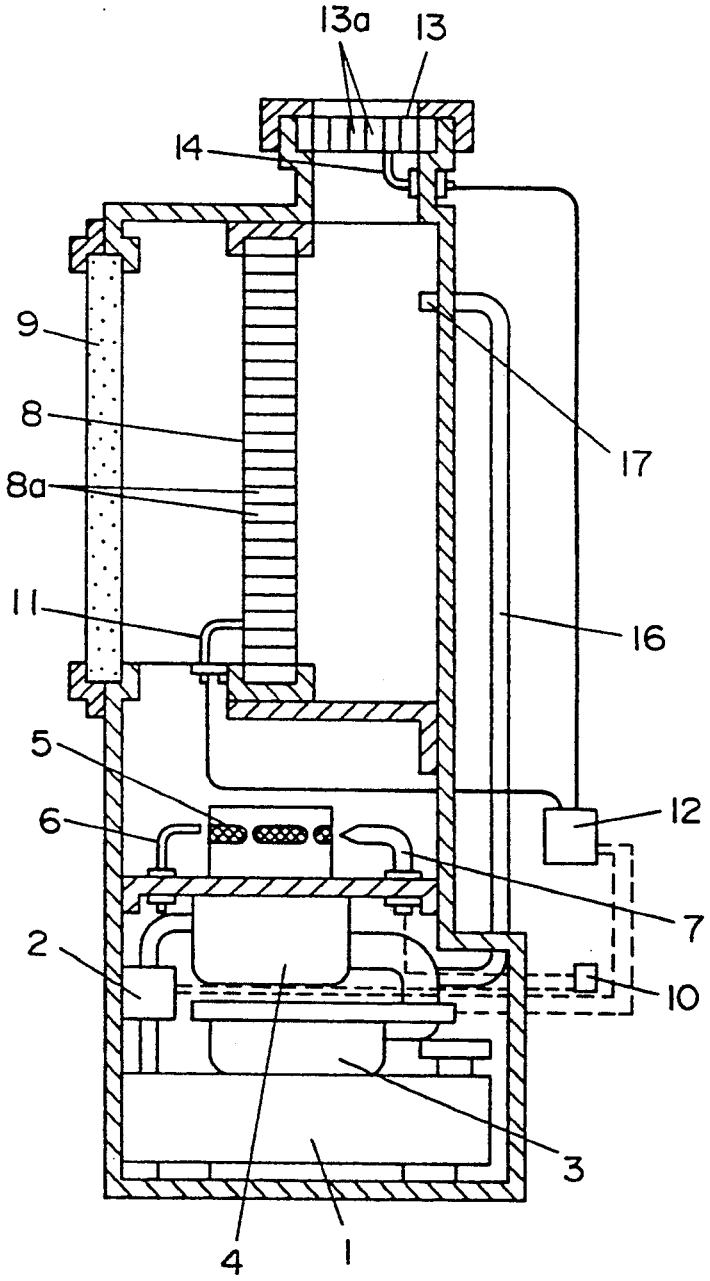

Next, a fourth embodiment will be described. Referring to FIG. 5, there is provided a secondary air tube 16 which is branched from the outlet port of the fan 3 and connected to a secondary air port 17 opening at the upstream side of the auxiliary catalyst layer 13. Referring to an operational example where the catalyst layer 8 and the auxiliary catalyst layer 13 are preheated by burning the fuel at the flame ports 5, and then the burning is switched to the kerosene catalytic burning at the catalyst layer 8 with an air ratio 1.8 to 2.0, the surface temperatures of the catalyst layer 8 and the auxiliary catalyst layer 13 vary according to the change of the oxygen density. In this case, the burning reaction is substantially completed at the upstream side surface of the catalyst layer 8, and the surface temperature reaches about 860° C. At this instant, the auxiliary catalyst layer 13 is heated only by the exhaust gas discharged from the catalyst layer 8, and the surface temperature thereof is as low as about 550° C. Even when the oxygen density is further lowered, the temperature difference between the catalyst layer 8 and the auxiliary catalyst layer 13 is maintained almost constant, because the oxygen amount is still sufficient (the actual oxygen excessive rate is about 1.3 to 1.4 in the case where the oxygen density becomes 15%). If the air amount to be supplied to the mixing room 4 is decreased by about 30%, the air ratio at the catalyst layer 8 become 1.3 to 1.4. In this condition, for obtaining a perfect combustion, the oxygen density more than 20% is required, and when the oxygen density become as low as 18%, the actual oxygen excessive rate become 1.1 to 1.2, thereby causing a fear to produce carbon monoxide or unburned gas. These combustible compositions are mixed with the air supplied from the secondary air port 17 and flowed toward the auxiliary catalyst layer 13, where a burning reaction is effected. As a result, at the catalyst layer 8, the burning reaction becomes weaker and the temperature becomes lower, while at the auxiliary catalyst layer 13, the burning reaction becomes stronger and the temperature becomes higher. When the oxygen density is furthermore lowered, the burning reaction becomes further weaker at the catalyst layer 8 and further stronger at the auxiliary catalyst layer 13. As a result, the temperatures of these two layers gradually approach to each other, and finally will be reversed. Now, by presetting a suitable temperature difference value and controlling the pump 2 so as to stop the fuel supply when the temperature difference becomes lower than the preset value, the burning in an oxygen starvation state can be prevented, and the adverse influence on human being and beasts can be avoided.

Requirement for setting the temperature difference depends on the target value of the oxygen limit density, the total amount of the burning, the area ratio of the catalyst layer 8 to the catalyst layer 13, and the predetermined air ratio, and it may be set in the control circuit 12. A suitable action can be easily carried out in response to a change of the total burning amount, if the predetermined temperature difference is previously stored in the control circuit 12. If the air supply rate to the mixing room 4 is maintained at the above-mentioned limit value, the operation may be apt to become unstable when the fuel supply amount or the air supply amount changes. For effecting a perfect combustion at the catalyst layer 8, it is basically preferred to supply sufficient air. Therefore, it is suitable to practice the above-mentioned air flow change process only for a short time such as 2 to 3 minutes at constant intervals of such as 30 minutes or one hour.

Figure 6:
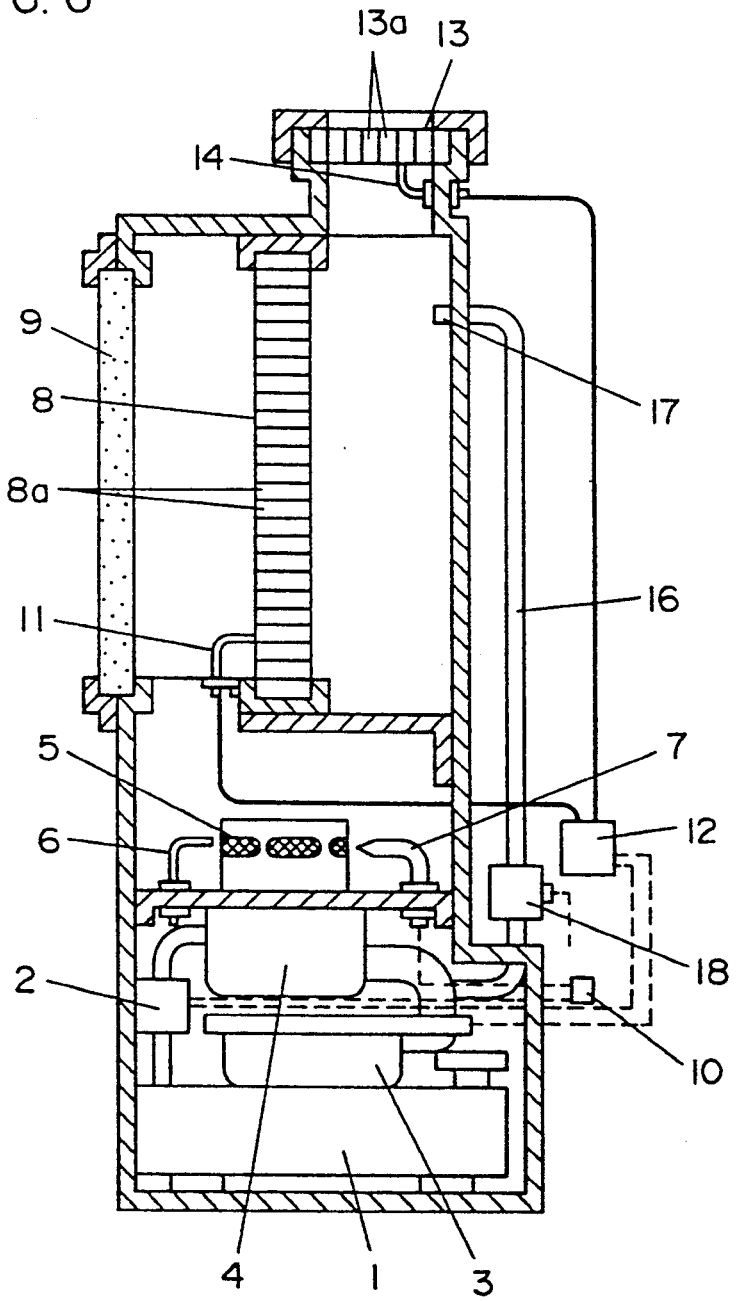

FIG. 6 shows a fifth embodiment, where there is provided a flow controller 18 including an opening and closing valve located at the middle of the secondary air tube 16 for opening the flow tube for a short time at certain intervals. When the flow controller 18 is opened, a part of the air to be supplied to the mixing room 4 is supplied to the secondary air port 17 through the secondary air tube 16. As a result, the air supplied to the mixing room 4 is decreased, and at the same time, an air supply to the upstream side of the auxiliary catalyst layer 13 is started, thereby producing the same effects as in the fourth embodiment. In this embodiment, no special operation of the fan 3 is required, and since no excessive air is supplied from the secondary air port 17 in a normal burning operation, the auxiliary catalyst layer 13 is not cooled, and can be maintained at a sufficiently high temperature, thereby assuring a perfect purifying power against unburned composition or carbon monoxide.

Next, a sixth embodiment will be described. In the arrangement shown in FIG. 3, platinum (Pt) is carried by the catalyst layer 8, and a composition produced by mixing palladium (Pd) and platinum at a weight ratio 2:1 is carried by the catalyst layer 13. The thickness of the catalyst layer 13 is about 80% of that of the catalyst layer 8, and the area of the former is about 30% of that of the latter, and the external volume of the former is about 24% of that of the latter. The cell density (number of the communicating holes 8*a*, 13*a* per unit area) of the honeycomb which constitutes the carrier is 300 cells/in$^2$) regarding the catalyst layer 8, while 400 cells/in$^2$ regarding the catalyst layer 13, and accordingly, the diameter of the communicating holes 13*a* is smaller than that of the communicating holes 8*a* by about 30%.

As mentioned above, the catalyst layer 8 and the catalyst layer 13 carry different precious metals, and there is also a difference between the reacting features of Pt and Pd on CO and kerosene as shown in FIG. 7. Namely, Pd has a higher activity in oxidizing of CO (here, 400 ppm CO is contained in the air), and in particular, a superior activity at low temperature. On the other hand, Pt has a higher activity in oxidizing of kerosene (here, 2% kerosene vapor is contained in the air), and has a perfect reacting feature (activity at a condition of near 100% transforming rate) which is significantly different from that of Pd. Therefore, in the arrangement of FIG. 3, Pt is used at the catalyst layer 8 for obtaining a superior burning reaction with kerosene, while Pd is mainly used at the auxiliary catalyst layer 13, which has a low temperature, for purifying Co, which constitutes a main reactive composition, efficiently at a low temperature. Although the reaction starting feature at the catalyst layer 8 is expected to be improved by mixing Pd, it is desired, for making the burning reaction more perfect, to use Pt only or Pt as a main composition. On the other hand, at the auxiliary catalyst layer 13, although Pd only may be used for purifying CO, Pt is preferred to be mixed in consideration of the fuel slip due to the activity deterioration or locally lowered temperature of the catalyst layer 8. With respect to the reactivity on the fuel, the above-mentioned activity difference is seen in gaseous fuels such as propane or butane similarly to the above-mentioned kerosene, and any gaseouf fuel excluding methane has the same feature.

Even if the volume of the auxiliary catalyst layer 13 is equal to that of the catalyst layer 8, there is no problem with respect to the performance. However, since a great size of the auxiliary catalyst layer 13 causes a high cost, an excessive size thereof is undesirable in the practical view point. The load on the auxiliary catalyst layer 13 is usually small, and a perfect reaction can be obtained, even if the spacial speed is considerably increased. FIG. 8 shows a relation between the volume ratio of the auxiliary catalyst layer 13 to the catalyst layer 8 and the transforming rate of the reactive substances. In an initial stage where the CO density is below 100 ppm, a perfect purification can be obtained even when the volume ratio of the auxiliary catalyst layer 13 to the catalyst layer 8 is made as low as 10% and the spacial gass speed is increased by about ten times. Even in a condition where no reaction is caused at the catalyst layer 8 (all fuel slips and reaches the auxiliary catalyst layer 13), an almost normal burning can be effected if the volume ratio of the auxiliary catalyst layer 13 is as great as 50%, thereby preventing a great amount of smell or CO from being exhausted, and preventing any abnormal condition such as a back-fire. An abnormality of the catalyst layer 8 can be detected by measuring the temperature rise of the auxiliary catalyst layer 13 by means of the thermocouple 14, and in response to this detected abnormality, the burning can be stopped. In consequence, considering the cost requirement, it is required to make the size of the auxiliary catalyst layer 13 minimum, and therefore, the volume ratio of the auxiliary catalyst layer 13 to the catalyst layer 8 may be preferably selected at 10 to 50% according to the precision of the temperature detection and the allowable value for deterioration of the catalyst layer 8.

The density of the unburned composition passing through the auxiliary catalyst layer 13 is far thin in comparison with that through the catalyst layer 8, and as a result, the diffusion of the reactive substance for oxidizing reaction become important. If the diameter of the communicating holes 13*a* of the auxiliary catalyst layer 13 is made smaller, in other words, the honeycomb cell density is made greater, the diffusion time of the unburned composition can be shortened and the reactivity is improved, resulting in a high transforming rate even at a low temperature, as shown in FIG. 9. In case of the catalyst layer 8, excessive cell density causes a reaction heat concentration and an excessive temperature rise, thereby deteriorating the catalytic activity. In case of the auxiliary catalyst layer 13, however, there is no such deterioration, because the produced heat is small due to the thin density of the gas. FIG. 9 indicates that if the cell density is increased, the reactivity is improved and the purification becomes perfect, even in case the volume of the auxiliary catalyst layer 13 is small (spacial speed is great). This structure is helpful for decreasing the size of the auxiliary catalyst layer 13 through which a gas of low temperature and low density passes. The greater density of the cell is accompanied with an increased flow resistance., and the cell density has an upper limit due to the restriction in fabrication. However, by making the diameter of the communicating holes 13*a* of the auxiliary catalyst layer 13 smaller than that of the communicating holes 8*a* of the catalyst layer 8, it become possible to purify the exhaust gas efficiently with a small volume and with a low cost.

In every case mentioned above, the carrier of the catalyst layer 8 or the auxiliary catalyst layer 13 is not limited to a ceramic honeycomb as shown in the above-mentioned embodiments, but a ceramic foam, a braided body of anti-heat fibers, or a metal honeycomb can be used with the same advantage obtained. The above-mentioned advantage is not influenced by the kind or the shape of the carrying body of the catalyst layer 8 or the auxiliary catalyst layer 13.

INDUSTRIAL APPLICABILITY

As mentioned above, in a catalytic burning apparatus according to the present invention, an uniform catalyst preheating can be effected in a short time, because the catalyst layer is preheated by utilizing a flame burning which produces an hot exhaust gas. Further, since it is confirmed by means of ion current detecting means that a stable flame is formed in a flame burning stage, and no flame is formed in a catalytic burning stage, any effusion of unburned gas due to misignition or misfire can be prevented. In addition, in a catalytic burning, it can be confirmed that there is not any backfire phenomenon, which may be caused by an overheating of the catalyst layer due to an abnormality of the pump or the fan and may form a flame at the flame ports. Further, by providing temperature detecting means for the catalyst layer, the preheat temperature of the catalyst layer can be suitably adjusted and a catalytic burning realizing a perfect reaction can be started from the initial stage. In case of an abnormal structure or an abnormal activity of the catalyst layer, the abnormality can be quickly detected and any smell or carbon monoxide due to an imperfect combustion can be prevented from being produced. By conducting flame burnings at certain intervals and confirming by ion electric current detecting means that a predetermined electric current is flowing, any abnormality of the oxygen density can be detected, and any oxygen starvation having a harmful influence on the human body can be prevented. By providing two stages of catalyst layers and detecting the temperature difference between these two catalyst layers, any activity deterioration or damage of the catalyst layers can be detected, and further, by supplying a secondary air to the upstream side of the catalyst layer (auxiliary catalyst layer) located at the downstream side, any oxygen starvation can be detected. By using Pt as a main composition for the upstream side catalyst layer, and Pd as a main composition for the downstream side catalyst layer, an optimum reaction suitable to the composition to be burned or the density of the same can be effected, thereby providing a burning apparatus capable of effecting a perfect reaction. By making smaller the volume of the downstream side catalyst layer having a smaller load, or making smaller the cell diameter of the downstream side catalyst layer having a lower combustible gas density, an efficient burning and an efficient exhaust gas purification can be effected at low cost.

We claim:

1. A catalytic burning apparatus comprising:

a mixing room for mixing fuel with air;

means provided downstream of said mixing room for forming flame-forming ports;

means containing a first catalyst layer disposed downstream of said flame-forming ports and formed with a plurality of communication holes;

ion current detecting means disposed near said flame-forming ports for measuring ion current in a flame exiting said flame-forming ports;

igniting means for igniting said fuel mixed with air at said flame-forming ports;

fuel supplying means for supplying fuel into said mixing room; and control mean operatively associated with said ion current detecting means and said fuel supplying means for controlling said fuel supplying means to stop fuel supply therefrom when said ion current detecting means detects an ion current in said flame having a magnitude which is above or below a predetermined magnitude, operating the igniting means at predetermined intervals for forming a flame at the flame-forming ports for a predetermined time, stopping the fuel supply when the ion current detecting means detects the condition that the predetermined magnitude of ion current exists, and restarting the catalytic burning through steps of temporarily stopping the fuel supply and resupplying the fuel, when the ion current detecting means detects that the predetermined magnitude of ion current exists.

2. A catalytic burning apparatus comprising:

a mixing room for mixing fuel with air;

means provided downstream of said mixing room for forming flame-forming ports;

means containing a first catalyst layer disposed downstream of said flame-forming ports and formed with a plurality of communication holes;

ion current detecting means disposed near said flame-forming ports for measuring ion current in a flame exiting said flame-forming ports;

igniting means or igniting said fuel mixed with air at said flame-forming ports;

fuel supplying means for supplying fuel into said mixing room;

control means operatively associated with said ion current detecting means and said fuel supplying means for controlling said fuel supplying means to stop fuel supply therefrom when said ion current detecting means detects an ion current in said flame having a magnitude which is above or below a predetermined magnitude;

means containing an auxiliary catalyst layer arranged downstream of the first catalyst layer and bored with a plurality of communicating holes;

temperature detecting means for detecting temperatures of said first catalyst layer and said auxiliary catalyst layer; and a secondary air supply section having an opening at the upstream side of the auxiliary catalyst layer, wherein said control means is interconnected with said temperature detecting means and decreases the air supply to the mixing room by a predetermined ratio at predetermined intervals and stops the fuel supply, when the temperature difference between said first and auxiliary catalyst layers is below a predetermined value.

3. A catalytic burning apparatus as claimed in claim 2: further comprising, air supply means communicating with both of said mixing room and said secondary air supply section, and flow control means for making a communication with said secondary air supply section at predetermined intervals for a predetermined time.

4. A catalytic burning apparatus claimed in claim 2, wherein said first catalyst layer includes one of platinum and a mixed precious metal mainly composed of platinum, and said auxiliary catalyst layer includes one of palladium and a mixed precious metal mainly composed of palladium.

5. A catalytic burning apparatus comprising:

a mixing room for mixing fuel with air;

means provided downstream of said mixing room for forming flame-forming ports;

means containing a first catalyst layer disposed downstream of said flame-forming ports and formed with a plurality of communication holes;

ion current detecting means disposed near said flame-forming ports for measuring ion current in a flame exiting said flame-forming ports;

igniting means for igniting said fuel mixed with air at said flame-forming ports;

fuel supplying means for supplying fuel into said mixing room;

control means operatively associated with said ion current detecting means and said fuel supplying means for controlling said fuel supplying means to stop fuel supply therefrom when said ion current detecting means detects an ion current in said flame having a magnitude which is above or below a predetermined magnitude; and means containing an auxiliary catalyst layer arranged downstream of the first catalyst layer and bored with a plurality of communicating holes, said first catalyst layer containing platinum or a mixed precious metal mainly composed of platinum, and said auxiliary catalyst layer containing palladium or a mixed precious metal mainly composed of palladium, wherein the auxiliary catalyst layer has a volume which is 10 to 50% that of the first catalyst layer.

6. A catalytic burning apparatus comprising:

a mixing room for mixing fuel with air;

means provided downstream of said mixing room for forming flame-forming ports;

means containing a first catalyst layer disposed downstream of said flame-forming ports and formed with a plurality of communication holes;

ion current detecting means disposed near said flame-forming ports for measuring ion current in a flame exiting said flame-forming ports;

igniting means for igniting said fuel mixed with air at said flame-forming ports;

fuel supplying means for supplying fuel into said mixing room;

control means operatively associated with said ion current detecting means and said fuel supplying means for controlling said fuel supplying means to stop fuel supply therefrom when said ion current detecting means detects an ion current in said flame having a magnitude which is above or below a predetermined magnitude; and means containing an auxiliary catalyst layer arranged downstream of the first catalyst layer and bored with a plurality of communicating holes, said first catalyst layer containing platinum or a mixed precious metal mainly composed of platinum, and said auxiliary catalyst layer containing palladium or a mixed precious metal mainly composed of palladium, wherein the communicating holes of the auxiliary catalyst layer have a diameter which is smaller than that of the first catalyst layer.

7. A catalytic burning apparatus claimed in claim 5, wherein the communicating holes of the auxiliary catalyst layer have a diameter which is smaller than that of the first catalyst layer.

* * * * *

UNITED STATES PATENT AND TRADEMARK OFFICE

CERTIFICATE OF CORRECTION

PATENT NO. : 5,158,448

DATED : October 27, 1992

INVENTOR(S) : Yoshitaka KAWASAKI, et al

It is certified that error appears in the above-indentified patent and that said Letters Patent is hereby corrected as shown below:

Claim 1, Column 10, line 44, change "detects" to —does not detect—.

Signed and Sealed this

Twenty-eighth Day of November 1995

*Attest:*

Bruce Lehman

BRUCE LEHMAN

*Attesting Officer*

*Commissioner of Patents and Trademarks*